US011680463B2

(12) United States Patent
Falnes

(10) Patent No.: US 11,680,463 B2
(45) Date of Patent: Jun. 20, 2023

(54) MULTILATERAL JUNCTION WITH INTEGRAL FLOW CONTROL

(71) Applicant: Halliburton Energy Services, Inc., Houston, TX (US)

(72) Inventor: Morten Falnes, Sola (NO)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/689,382

(22) Filed: Nov. 20, 2019

(65) Prior Publication Data

US 2020/0173260 A1 Jun. 4, 2020

Related U.S. Application Data

(60) Provisional application No. 62/773,866, filed on Nov. 30, 2018.

(51) Int. Cl.
*E21B 41/00* (2006.01)
*E21B 33/10* (2006.01)
*E21B 34/06* (2006.01)

(52) U.S. Cl.
CPC ..... *E21B 41/0042* (2013.01); *E21B 33/10* (2013.01); *E21B 34/06* (2013.01);
(Continued)

(58) Field of Classification Search
CPC ..... E21B 41/0042; E21B 33/10; E21B 34/06; E21B 41/0035; E21B 2200/02; E21B 2200/06
See application file for complete search history.

(56) References Cited

U.S. PATENT DOCUMENTS 4,425,965 A * 1/1984 Bayh, III ..... E21B 34/08 285/264
6,125,937 A * 10/2000 Longbottom ..... E21B 23/12 166/50

(Continued)

FOREIGN PATENT DOCUMENTS

RU 2449107 C2 4/2012
WO WO2017086936 A1 * 5/2017

OTHER PUBLICATIONS

International Search Report and Written Opinion dated Mar. 17, 2020—International PCT Application No. PCT/US2019/062927.

*Primary Examiner* — Jonathan Malikasim
(74) *Attorney, Agent, or Firm* — Barnes & Thornburg LLP

(57) ABSTRACT

A multilateral junction comprising a y-block and a port seal member. The y-block comprises a main bore, a lateral bore, and lateral port formed in the y-block. The port seal member is integrated within the main bore and has at least one of an opened, closed, and choked position. The multilateral junction also includes one or more gaskets configured to hydraulically isolate the lateral bore when the port seal member is in a closed position. The multilateral junction may further include a controller coupled to the port seal member for performing at least one of an opening, closing, and choking operation on the port seal member. The y-block is a single, machined object with the main bore and the lateral bore formed therein. The multilateral junction is useful in applications that require pressure tight seals and minimal restriction of the internal diameter of a main bore.

20 Claims, 6 Drawing Sheets

(52) U.S. Cl.
CPC ..... *E21B 41/0035* (2013.01); *E21B 2200/02* (2020.05); *E21B 2200/06* (2020.05)

(56) References Cited

U.S. PATENT DOCUMENTS

| | | | | |
|---|---|---|---|---|
| 6,216,788 | B1 * | 4/2001 | Wilson | E21B 37/00 166/105.1 |
| 6,343,651 | B1 * | 2/2002 | Bixenman | E21B 33/124 166/278 |
| 6,371,208 | B1 | 4/2002 | Norman et al. | |
| 6,561,277 | B2 * | 5/2003 | Algeroy | E21B 43/14 166/50 |
| 7,363,983 | B2 * | 4/2008 | Martinez | E21B 43/124 166/372 |
| 10,060,225 | B2 * | 8/2018 | Wolf | E21B 23/12 |
| 2015/0233190 | A1 | 8/2015 | Wolf et al. | |
| 2016/0273312 | A1 * | 9/2016 | Steele | E21B 17/18 |

* cited by examiner

MULTILATERAL JUNCTION WITH INTEGRAL FLOW CONTROL

CROSS-REFERENCE TO RELATED APPLICATIONS

This application claims priority to U.S. Provisional Application No. 62/773,866 filed on Nov. 30, 2018, the entire disclosure of which is expressly incorporated herein by reference.

BACKGROUND

The oil and gas industry uses multilateral junctions for the development and production of lateral wells, i.e. hydrocarbon reservoirs. A multilateral line integrates with a main bore well line at the multilateral junction. This integration point, per industry standard, is required, in some applications, to be pressure tight and functional to open, close, and choke the lateral fluid flow. Traditional multilateral junctions, however, suffer from a design limitation. The traditional pressure tight multilateral junctions are multi-part components, e.g. a main block, which comprises a main bore, and a lateral junction tubing, joint, and seal. For a pressure tight multilateral junction, there are traditionally two ways of achieving branch control or being able to shut in a lateral. One is to have a flow control device installed in either a main bore or lateral below the junction y-block. The flow control device can be operated to isolate or choke the flow from either the lateral or main bore depending on the application and setup. Another way is to install flow control devices above the junction y-block. This means that the two flow streams must be segregated through the multilateral junction, by for example installing a seal assembly into a polished bore receptacle (PBR) that is attached to either the main bore side or the lateral side of the y-block. Inherently, such a design will only have mechanical access with intervention tools (wire line or coiled tubing) to the side with the PBR attached. The method by which the PBR is attached into the y-block will introduce a geometry that restricts access further, i.e. having a "kink" that reduces the effective inside diameter (ID). A ball, e.g., could roll through but a long and rigid tool with the same outside diameter (OD) would not be able to pass because of the kink.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1:
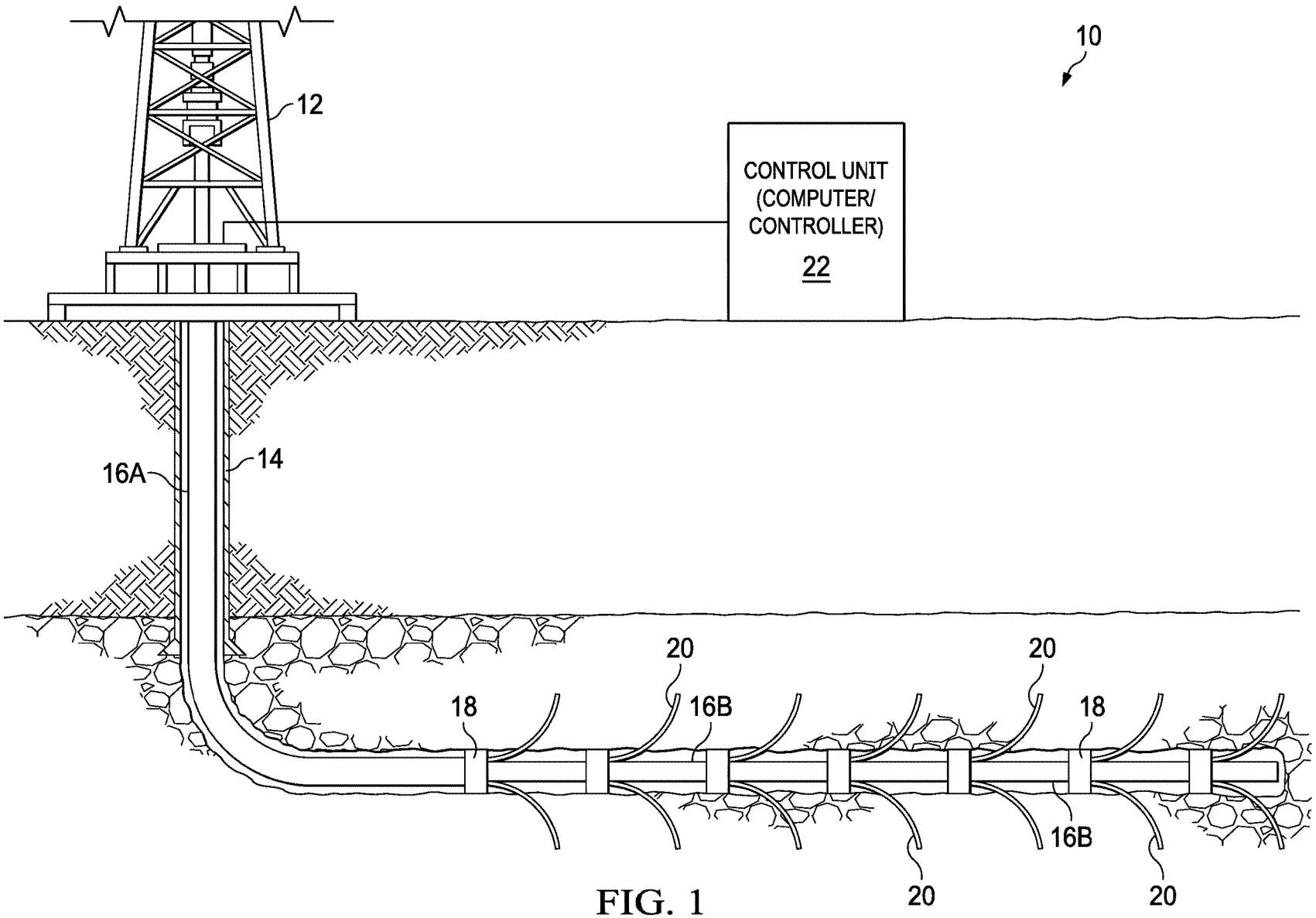
FIG. 1 is an illustration of a diagram of a well site for hydrocarbon reservoir production, according to certain example embodiments.

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

A particular challenge for the oil and gas industry is developing a pressure tight TAML (Technology Advancement of Multilaterals) level 5 multilateral junction that can be installed in 7 feet and ⅝" casing and that also allows for ~3 feet and ½" ID access to a main bore after the junction is installed. An additional challenge is that the multilateral junction should be able to hydraulically isolate the lateral branch during, e.g., stimulation operations of the main bore or shut off lateral production. This type of multilateral junction could be useful for coiled tubing conveyed stimulation and/or clean-up operations. It is envisaged that future multilateral wells will be drilled from existing slots/wells where additional laterals are added to the existing well bore. If a side track can be made from 9 feet ⅝" casing, there is an option to install a 7" or 7⅝" liner with a new casing exit point positioned at an optimal location to reach undrained reserves. There are currently no existing level 5 multilateral junctions that offer the possibility to hydraulically isolate the lateral without additional completion equipment, such as seal assemblies and valves. This constraint will necessarily impose an ID restriction when installed.

Presented herein is a pressure tight, multilateral junction with an integral flow control device for use in well development and production. The multilateral junction comprises a y-block having a main bore, a lateral bore, and lateral port formed in the y-block. This is a single machined or otherwise manufactured object that includes the bores and the port. A flow control device, or i.e. a port seal member, e.g. a sleeve, is integrated within the main bore. The flow control device may be shifted mechanically by well intervention. Alternatively, the multilateral junction may include a controller to cause the sleeve to move between an opened, closed and choked position. At least one gasket is positioned between the sleeve and the y-block and configured to hydraulically isolate the lateral bore when the port seal member is in a closed position. Even though the problem described above only referenced 7⅝" junction systems, the concepts and ideas discussed herein are also applicable to other junction sizes, e.g. 7", 9⅝" and 10¾".

Referring now to FIG. 1, illustrated is a diagram of a well site for hydrocarbon reservoir production, according to certain example embodiments, denoted generally as 10. The well site 10 includes a pumping station 12, a wellbore 14, tubing 16A and 16B, which may have differing tubular diameters, and a plurality of multilateral junctions 18, and lateral legs 20 with additional tubing integrated with a main bore of the tubing 16. Each multilateral junction 18 comprises a main bore, lateral bore, and a mechanism, e.g. a sleeve, that can be acted upon to open, close, and choke the lateral bore. The mechanism can be manipulated through a control unit 22 using conventional industry practices, such as wireline, coiled tubing operations, or through hydraulic manipulation, or through more advanced methods, such as wireline or wireless manipulation using electronics and software. The multilateral junctions 18 each can be manipulated separately, all at once, or a combination thereof to stimulate a reservoir and used to draw fluid into the main bore during production.

Figure 2A:
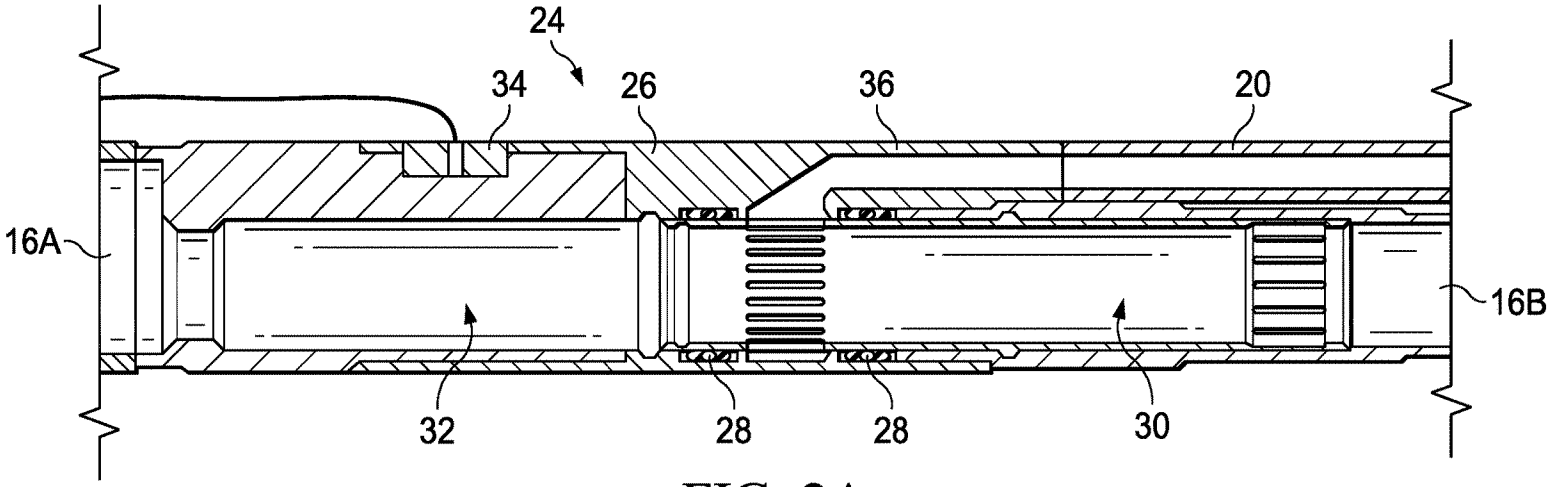
FIGS. 2A-2B are illustrations of cross sectional views of a multilateral junction, according to certain example embodiments.
Figure 2B:
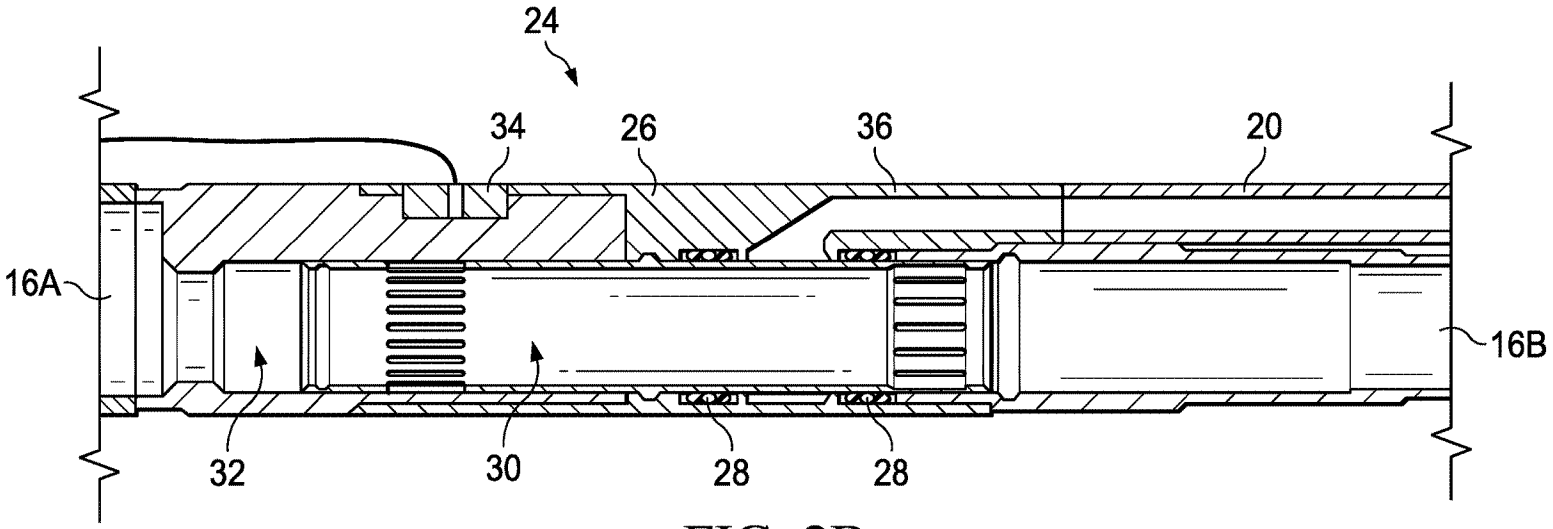

Referring now to FIGS. 2A-2B, illustrated are cross sectional views of multilateral junction 18, according to certain example embodiments. The multilateral junction 18 comprises an upper assembly 24, a y-block 26, at least one gasket 28, and a sleeve 30. The upper assembly 26 comprises a step down tubing 32 and an actuator 34. The sleeve 30 is positioned inside the main bore of the y-block 26. The actuator 34 is used to cause the sleeve 30 to move from its open position, see FIG. 2A, to its closed position, see FIG. 2B. In one embodiment, the actuator 34 is communicable coupled to control unit 22 and responsive to commands issued therefrom. In another embodiment, the sleeve 30 can be mechanically manipulated using traditional well intervention tools. Alternatively, the sleeve 30 can be manipulated using traditional well intervention tools without the need of the actuator 34. The sleeve 30 includes at least one aperture and the y-block 26 includes a lateral port 36 coupled to the lateral leg 20. In the open position, fluid communication is allowed between the main bore and the lateral leg 20 through the at least one aperture and the lateral port 36. The at least one gasket 28 is positioned on at least one side of the lateral port 36 and between the sleeve 30 and the body of the y-block 26. The at least one gasket 28 creates a pressure tight seal isolating the lateral port 36 when the sleeve 30 is in the closed position. In addition, the sleeve 30 can be adjusted to a choke position, which allows partial flow through the lateral bore. Stated differently, the sleeve can be placed in an equalizing position, which allows partial hydraulic communication to equalize pressure across the sleeve 30.

The step down tubing 32 is coupled to tubing 16A and the y-block 26 is coupled to tubing 16B using industry techniques, methods, and practices, e.g., male and female threads, collars, welding, gaskets, or any combination thereof. The y-block 26 is configured to couple with step down tubing 32 also using industry techniques, methods, and practices. In an embodiment, the lateral leg 20 is welded to the y-block 26. However, obviously, other industry techniques, methods, and practices can be used. The y-block 26 is a single unit, machined or otherwise manufactured, that comprises a main bore and the lateral port 36. By machining or otherwise manufacturing the y-block as a single entity, a consistent internal diameter of the main bore can be realized over the length of the multilateral junction 18.

Figure 3A:
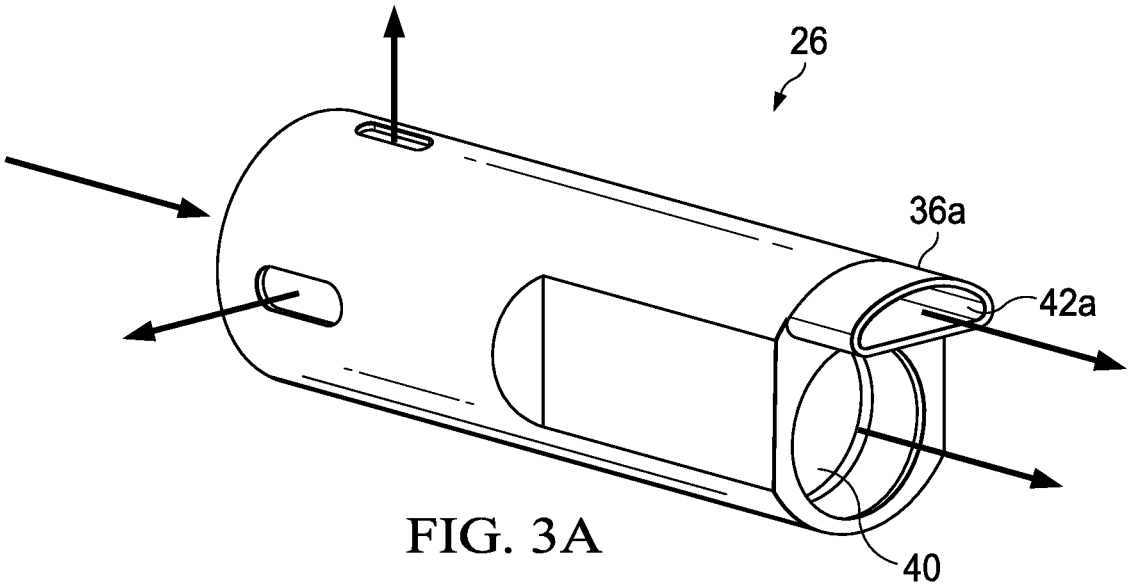
FIGS. 3A-3B are illustrations of isometric views of a y-block of the multilateral junction, according to certain example embodiments.
Figure 3B:
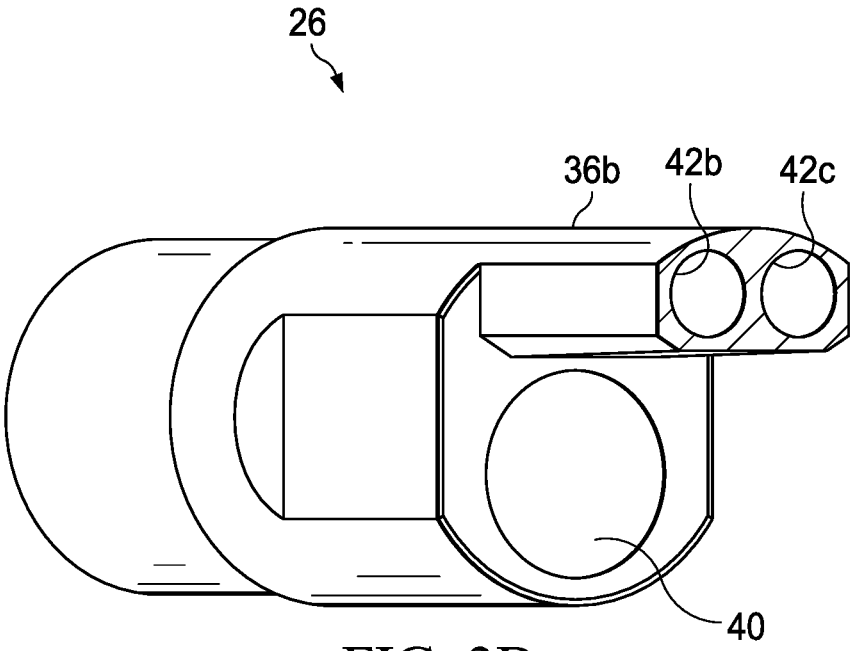
Figure 4:
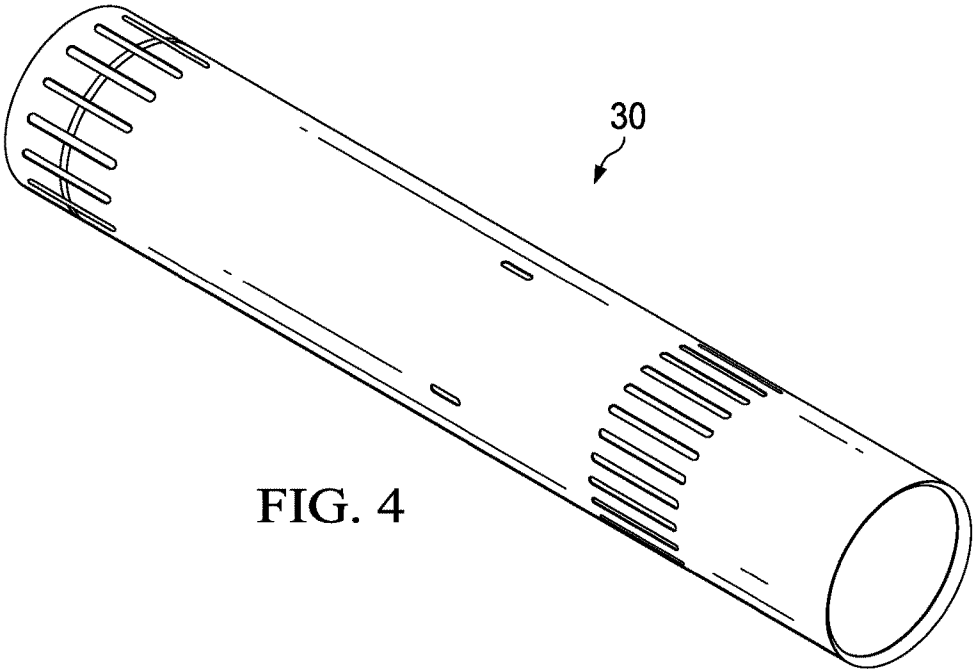
FIG. 4 is an illustration of an isometric view of the sleeve for use with the y-block, according to certain example embodiments.
Figure 5:
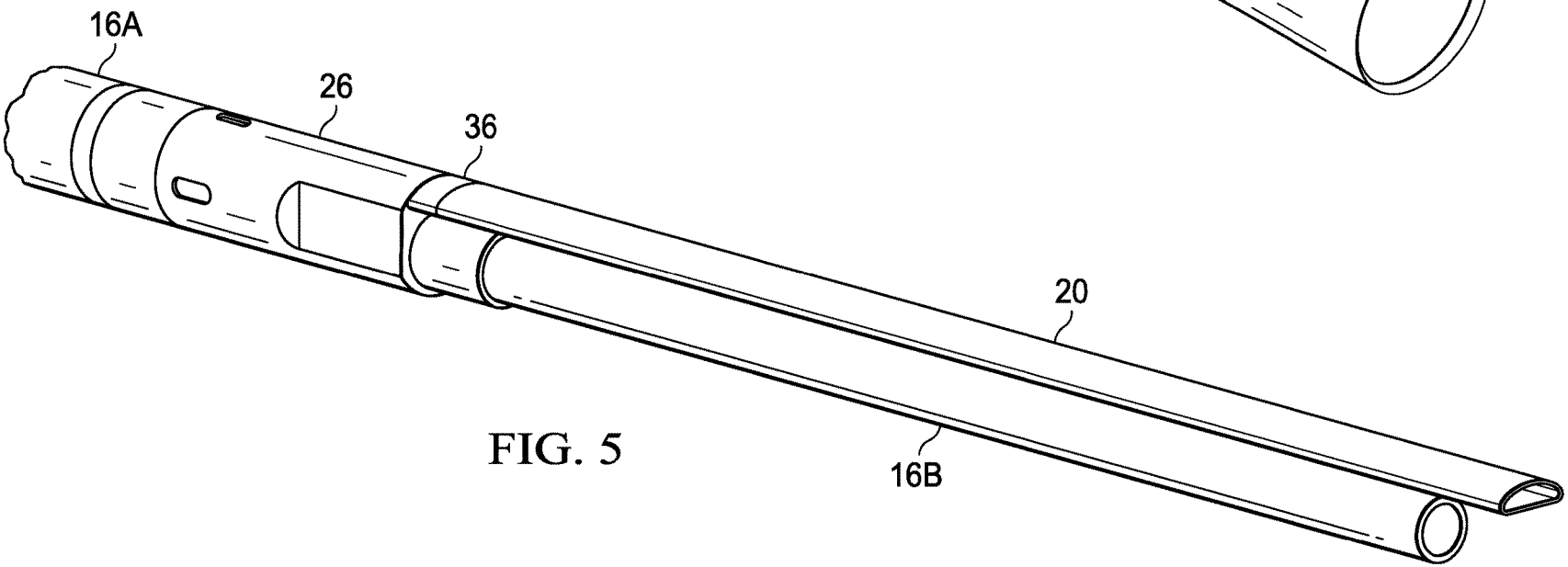
FIG. 5 is another isometric view of the y-block coupled to sections of tubing and a lateral leg, according to certain example embodiments.
Figure 6:
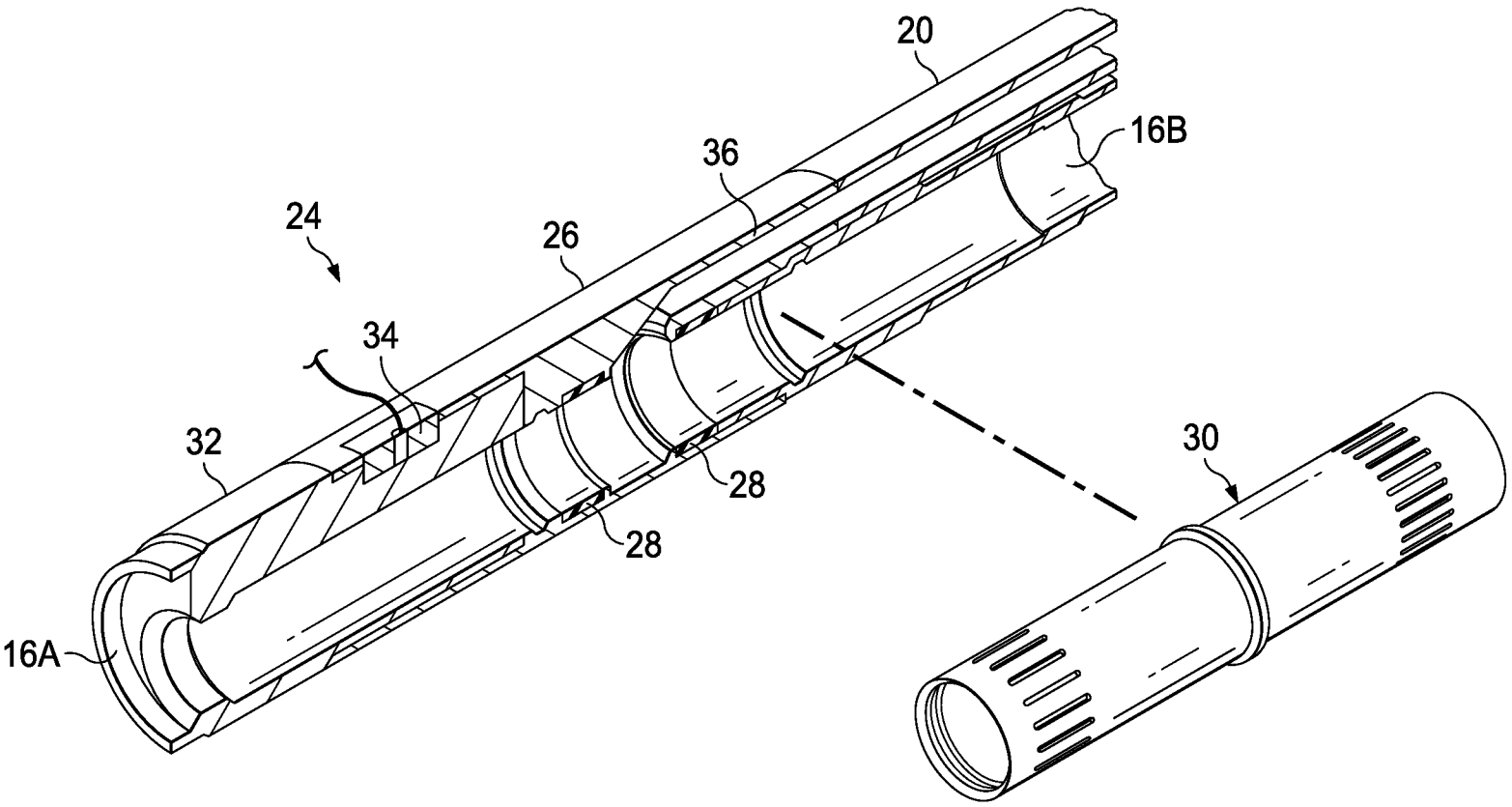
FIG. 6 is yet an isometric view of the y-block, tubing, lateral leg, and sleeve, in accordance with example embodiments.

Referring now to FIGS. 3A-3B, illustrated are isometric views of the y-block 26, in accordance with example embodiments. FIG. 4 is also an isometric view of the sleeve, in accordance with example embodiments. The sleeve 30 comprises a series of apertures on at least one end 30. In one embodiment, the y-block 26 is a machined part that includes a main bore 40 and a lateral bore 42*a*. In another embodiment, the y-block 26 is a machined part that includes a main bore 40 and a lateral bore 42*b, c*. The sleeve 30 when positioned in the main bore 40 in a first setting can be manipulated by the actuator 34 and re-positioned into a second setting. Setting in this context can refer to, e.g., grooves, ridges, flanges, or something equivalent thereto that would allow the actuator 34 to move the sleeve 30 from the different positions. Although, it has been described that the sleeve 30 can be slid from a first to a second position it should be understand that it can also be rotated between positions. FIG. 5 is another isometric view of the y-block 26 coupled to tubing 16A, 16B and lateral leg 20, in accordance with example embodiments. As is illustrated in FIGS. 3A and 3B, the profile of lateral port 36*a* and 36*b* are D-shaped and lateral bore 42*a* is D-shaped and lateral bores 42*b*, 4*c* are circular. The profiles offer the largest flow area and cross sectional area for the junction leg, being constrained in a round tube. The purpose of a specific profile is to make the most use of an available space. FIG. 6 is yet another isometric view of the y-block 26 and sleeve 30, in accordance with example embodiments.

Figure 7:
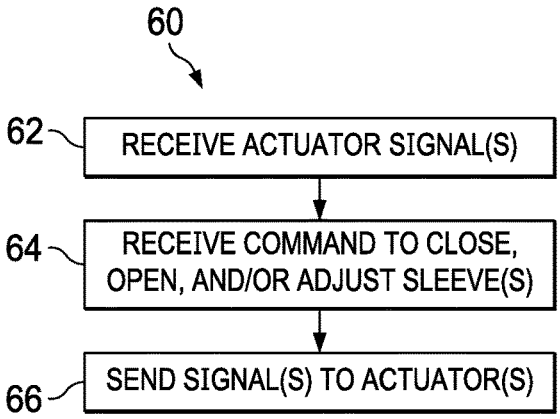
FIG. 7 is an illustration of a flow diagram of an actuator control algorithm for a surface based control unit, according to certain example embodiments.

Referring now to FIG. 7, illustrated is a flow diagram of an actuator control algorithm for control unit 22, in accordance with example embodiments, denoted generally as 60. The actuator control algorithm 60 begins at block 62 where an actuator signal or signals is received. In an embodiment, each signal can be encoded to identify the actuator 34. This information, e.g., can be displayed to a site operator. At block 64, a command or commands identifying at least one actuator 34 and a function, such as open, close, and adjust, is received and processed. At block 66, at least one actuator activation signal is sent to at least one actuator 34. The at least one actuator 34 responds by either opening, closing, or adjusting the sleeve 30.

Figure 8:
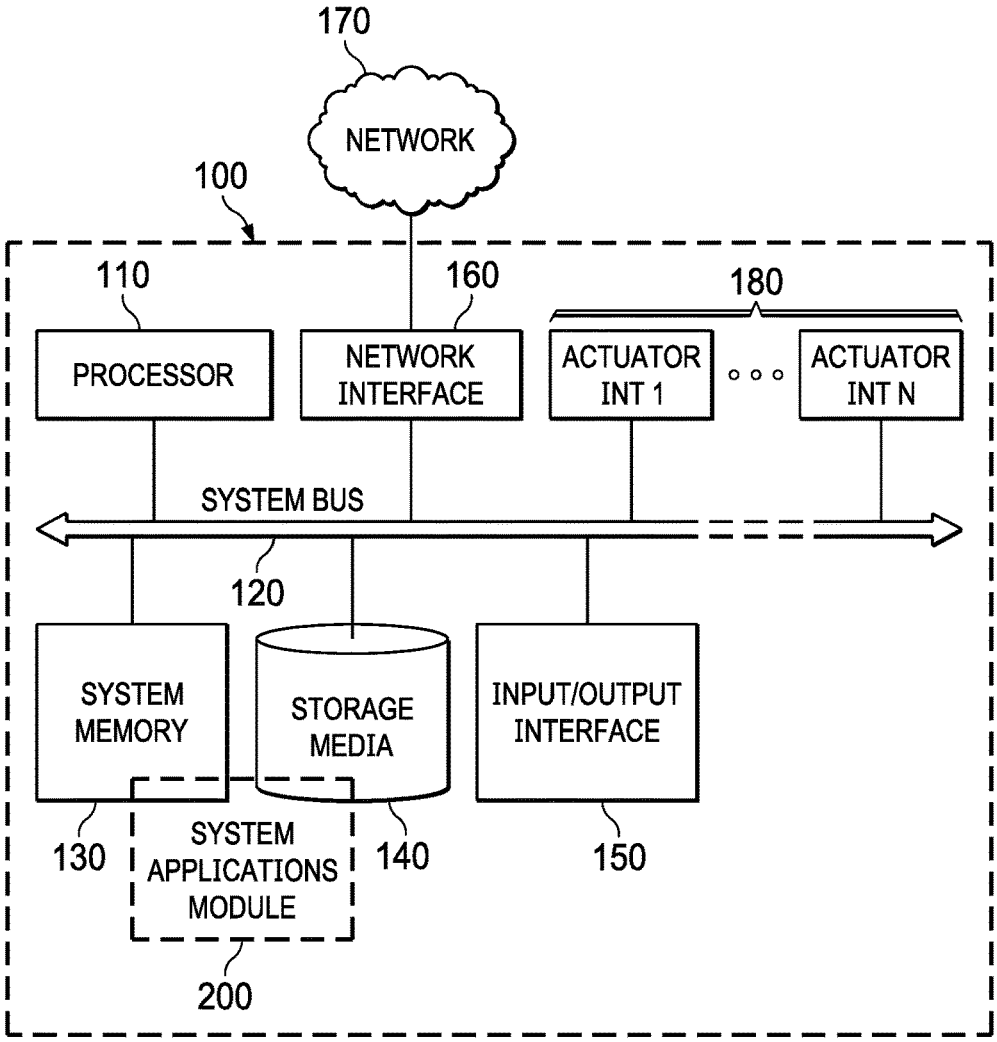
FIG. 8 is a block diagram depicting a computing machine and system applications, according to certain example embodiments.

Referring now to FIG. 8, illustrated is a computing machine 100 and a system applications module 200, in accordance with example embodiments. The computing machine 100 can correspond to any of the various computers, mobile devices, laptop computers, servers, embedded systems, or computing systems presented herein. The module 200 can comprise one or more hardware or software elements, e.g. other OS application and user and kernel space applications, designed to facilitate the computing machine 100 in performing the various methods and processing functions presented herein. The computing machine 100 can include various internal or attached components such as a processor 110, system bus 120, system memory 130, storage media 140, input/output interface 150, a network interface 160 for communicating with a network 170, e.g. local loop, cellular/GPS, Bluetooth, or WIFI, and a series of actuator interfaces 180 for interfacing with at least one actuator 34.

The computing machines can be implemented as a conventional computer system, an embedded controller, a laptop, a server, a mobile device, a smartphone, a wearable computer, a customized machine, any other hardware platform, or any combination or multiplicity thereof. The computing machines can be a distributed system configured to function using multiple computing machines interconnected via a data network or bus system.

The processor 110 can be designed to execute code instructions in order to perform the operations and functionality described herein, manage request flow and address mappings, and to perform calculations and generate commands. The processor 110 can be configured to monitor and control the operation of the components in the computing machines. The processor 110 can be a general purpose processor, a processor core, a multiprocessor, a reconfigurable processor, a microcontroller, a digital signal processor ("DSP"), an application specific integrated circuit ("ASIC"), a controller, a state machine, gated logic, discrete hardware components, any other processing unit, or any combination or multiplicity thereof. The processor 110 can be a single processing unit, multiple processing units, a single processing core, multiple processing cores, special purpose processing cores, co-processors, or any combination thereof. According to certain embodiments, the processor 110 along with other components of the computing machine 100 can be a software based or hardware based virtualized computing machine executing within one or more other computing machines.

The system memory 130 can include non-volatile memories such as read-only memory ("ROM"), programmable read-only memory ("PROM"), erasable programmable read-only memory ("EPROM"), flash memory, or any other device capable of storing program instructions or data with or without applied power. The system memory 130 can also include volatile memories such as random access memory ("RAM"), static random access memory ("SRAM"), dynamic random access memory ("DRAM"), and synchronous dynamic random access memory ("SDRAM"). Other types of RAM also can be used to implement the system memory 130. The system memory 130 can be implemented using a single memory module or multiple memory modules. While the system memory 130 is depicted as being part of the computing machine, one skilled in the art will recognize that the system memory 130 can be separate from the computing machine 100 without departing from the scope of the subject technology. It should also be appreciated that the system memory 130 can include, or operate in conjunction with, a non-volatile storage device such as the storage media 140.

The storage media 140 can include a hard disk, a floppy disk, a compact disc read-only memory ("CD-ROM"), a digital versatile disc ("DVD"), a Blu-ray disc, a magnetic tape, a flash memory, other non-volatile memory device, a solid state drive ("SSD"), any magnetic storage device, any optical storage device, any electrical storage device, any semiconductor storage device, any physical-based storage device, any other data storage device, or any combination or multiplicity thereof. The storage media 140 can store one or more operating systems, application programs and program modules, data, or any other information. The storage media 140 can be part of, or connected to, the computing machine. The storage media 140 can also be part of one or more other computing machines that are in communication with the computing machine such as servers, database servers, cloud storage, network attached storage, and so forth.

The applications module 200 and other OS application modules can comprise one or more hardware or software elements configured to facilitate the computing machine with performing the various methods and processing functions presented herein. The applications module 200 and other OS application modules can include one or more algorithms or sequences of instructions stored as software or firmware in association with the system memory 130, the storage media 140 or both. The storage media 140 can therefore represent examples of machine or computer readable media on which instructions or code can be stored for execution by the processor 110. Machine or computer readable media can generally refer to any medium or media used to provide instructions to the processor 110. Such machine or computer readable media associated with the applications module 200 and other OS application modules can comprise a computer software product. It should be appreciated that a computer software product comprising the applications module 200 and other OS application modules can also be associated with one or more processes or methods for delivering the applications module 200 and other OS application modules to the computing machine via a network, any signal-bearing medium, or any other communication or delivery technology. The applications module 200 and other OS application modules can also comprise hardware circuits or information for configuring hardware circuits such as microcode or configuration information for an FPGA or other PLD. In one exemplary embodiment, applications module 200 and other OS application modules can include algorithms capable of performing the functional operations described by the flow charts and computer systems presented herein.

The input/output ("I/O") interface 150 can be configured to couple to one or more external devices, to receive data from the one or more external devices, and to send data to the one or more external devices. Such external devices along with the various internal devices can also be known as peripheral devices. The I/O interface 150 can include both electrical and physical connections for coupling the various peripheral devices to the computing machine or the processor 110. The I/O interface 150 can be configured to communicate data, addresses, and control signals between the peripheral devices, the computing machine, or the processor 110. The I/O interface 150 can be configured to implement any standard interface, such as small computer system interface ("SCSI"), serial-attached SCSI ("SAS"), fiber channel, peripheral component interconnect ("PCP"), PCI express (PCIe), serial bus, parallel bus, advanced technology attached ("ATA"), serial ATA ("SATA"), universal serial bus ("USB"), Thunderbolt, FireWire, various video buses, and the like. The I/O interface 150 can be configured to implement only one interface or bus technology. Alternatively, the I/O interface 350 can be configured to implement multiple interfaces or bus technologies. The I/O interface 150 can be configured as part of, all of, or to operate in conjunction with, the system bus 120. The I/O interface 150 can include one or more buffers for buffering transmissions between one or more external devices, internal devices, the computing machine, or the processor 120.

The I/O interface 120 can couple the computing machine to various input devices including mice, touch-screens, scanners, electronic digitizers, sensors, receivers, touchpads, trackballs, cameras, microphones, keyboards, any other pointing devices, or any combinations thereof. The I/O interface 120 can couple the computing machine to various output devices including video displays, speakers, printers, projectors, tactile feedback devices, automation control, robotic components, actuators, motors, fans, solenoids, valves, pumps, transmitters, signal emitters, lights, and so forth.

The computing machine 100 can operate in a networked environment using logical connections through the network interface 160 to one or more other systems or computing machines across a network. The network can include wide area networks (WAN), local area networks (LAN), intranets, the Internet, wireless access networks, wired networks, mobile networks, telephone networks, optical networks, or combinations thereof. The network can be packet switched, circuit switched, of any topology, and can use any communication protocol. Communication links within the network can involve various digital or an analog communication media such as fiber optic cables, free-space optics, waveguides, electrical conductors, wireless links, antennas, radio-frequency communications, and so forth.

The processor 110 can be connected to the other elements of the computing machine or the various peripherals discussed herein through the system bus 120. It should be appreciated that the system bus 120 can be within the processor 110, outside the processor 110, or both. According to some embodiments, any of the processors 110, the other elements of the computing machine, or the various peripherals discussed herein can be integrated into a single device such as a system on chip ("SOC"), system on package ("SOP"), or ASIC device.

Embodiments may comprise a computer program that embodies the functions described and illustrated herein, wherein the computer program is implemented in a computer system that comprises instructions stored in a machine-readable medium and a processor that executes the instructions. However, it should be apparent that there could be many different ways of implementing embodiments in computer programming, and the embodiments should not be construed as limited to any one set of computer program instructions unless otherwise disclosed for an exemplary embodiment. Further, a skilled programmer would be able to write such a computer program to implement an embodiment of the disclosed embodiments based on the appended flow charts, algorithms and associated description in the application text. Therefore, disclosure of a particular set of program code instructions is not considered necessary for an adequate understanding of how to make and use embodiments. Further, those skilled in the art will appreciate that one or more aspects of embodiments described herein may be performed by hardware, software, or a combination thereof, as may be embodied in one or more computing systems. Moreover, any reference to an act being performed by a computer should not be construed as being performed by a single computer as more than one computer may perform the act.

The example embodiments described herein can be used with computer hardware and software that perform the methods and processing functions described previously. The systems, methods, and procedures described herein can be embodied in a programmable computer, computer-executable software, or digital circuitry. The software can be stored on computer-readable media. For example, computer-readable media can include a floppy disk, RAM, ROM, hard disk, removable media, flash memory, memory stick, optical media, magneto-optical media, CD-ROM, etc. Digital circuitry can include integrated circuits, gate arrays, building block logic, field programmable gate arrays (FPGA), etc.

The example systems, methods, and acts described in the embodiments presented previously are illustrative, and, in alternative embodiments, certain acts can be performed in a different order, in parallel with one another, omitted entirely, and/or combined between different example embodiments, and/or certain additional acts can be performed, without departing from the scope and spirit of various embodiments. Accordingly, such alternative embodiments are included in the description herein.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes one or more microcomputers or other suitable data processing units, memory devices, input-output devices, displays, data input devices such as a keyboard or a mouse, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections. The term "data" can refer to a suitable structure for using, conveying or storing data, such as a data field, a data buffer, a data message having the data value and sender/receiver address data, a control message having the data value and one or more operators that cause the receiving system or component to perform a function using the data, or other suitable hardware or software components for the electronic processing of data.

In general, a software system is a system that operates on a processor to perform predetermined functions in response to predetermined data fields. For example, a system can be defined by the function it performs and the data fields that it performs the function on. As used herein, a NAME system, where NAME is typically the name of the general function that is performed by the system, refers to a software system that is configured to operate on a processor and to perform the disclosed function on the disclosed data fields. Unless a specific algorithm is disclosed, then any suitable algorithm that would be known to one of skill in the art for performing the function using the associated data fields is contemplated as falling within the scope of the disclosure. For example, a message system that generates a message that includes a sender address field, a recipient address field and a message field would encompass software operating on a processor that can obtain the sender address field, recipient address field and message field from a suitable system or device of the processor, such as a buffer device or buffer system, can assemble the sender address field, recipient address field and message field into a suitable electronic message format (such as an electronic mail message, a TCP/IP message or any other suitable message format that has a sender address field, a recipient address field and message field), and can transmit the electronic message using electronic messaging systems and devices of the processor over a communications medium, such as a network. One of ordinary skill in the art would be able to provide the specific coding for a specific application based on the foregoing disclosure, which is intended to set forth exemplary embodiments of the present disclosure, and not to provide a tutorial for someone having less than ordinary skill in the art, such as someone who is unfamiliar with programming or processors in a suitable programming language. A specific algorithm for performing a function can be provided in a flow chart form or in other suitable formats, where the data fields and associated functions can be set forth in an exemplary order of operations, where the order can be rearranged as suitable and is not intended to be limiting unless explicitly stated to be limiting.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a multilateral junction apparatus for use with tubular piping in a wellbore environment, the apparatus comprising: a y-block comprising a main bore, a lateral bore, and lateral port formed in the y-block; and a port seal member having at least one of an opened, closed, and choked position; wherein the port seal member integrates with the main bore of the y-block;

Clause 2, the multilateral junction apparatus of clause 1, further comprising at least one gasket between the y-block and the port seal member, the at least one gasket configured to hydraulically isolate the lateral bore when the port seal member is in a closed position;

Clause 3, the multilateral junction apparatus of clause 1, further comprising a controller coupled to the port seal member for performing at least one of an opening, closing, and choking operation on the port seal member;

Clause 4, the multilateral junction apparatus of clause 3, wherein the port seal member is controllable using at least one of a mechanical, hydraulic, electromechanical, and electromagnetic means;

Clause 5, the multilateral junction apparatus of clause 4, wherein the controller performs an opening, closing, and choking operation on at least one port seal member using a device identifier and a control command;

Clause 6, the multilateral junction apparatus of clause 1, wherein the lateral port is one of a D-shape and circular shape and configured to couple to a lateral leg;

Clause 7, the multilateral junction apparatus of clause 1, wherein the y-block is a single, machined object with the main bore and the lateral bore formed therein;

Clause 8, a method of using a multilateral junction apparatus with tubular piping in a wellbore environment, the method comprising: machining a y-block to form a main bore, a lateral bore, and lateral port; integrating a port seal member within the y-block, wherein the port seal member includes at least one of an opened, closed, and choked position; coupling a first main bore tubular with an upper end of the y-block; coupling a second main bore tubular with a lower end of the y-block; coupling a lateral leg with the lateral port; performing downhole wellbore operations; and controlling operation of the port seal member during downhole operations;

Clause 9, the method of clause 8, further comprising positioning at least one gasket between the y-block and the port seal member, the at least one gasket configured to hydraulically isolate the lateral bore when the port seal member is in a closed position;

Clause 10, the method of clause 8 further comprising, performing at least one of an opening, closing, and choking operation on the port seal member;

Clause 11, the method of clause 10 further comprising, controlling the port seal member using at least one of a mechanical, hydraulic, electromechanical, and electromagnetic means;

Clause 12, the method of clause 11 further comprising, performing an opening, closing, and choking operation on at least one port seal member using a device identifier and a control command;

Clause 13, the method of clause 8 further comprises, wherein the lateral port is one of a D-shape and circular shape and configured to couple to a lateral leg;

Clause 14, the method of clause 1 wherein the y-block is a single, machined object with the main bore and the lateral bore formed therein;

Clause 15, a multilateral junction system for use with tubular piping in a wellbore environment, the system comprising: a y-block comprising a main bore, a lateral bore, and lateral port formed in the y-block; a port seal member having at least one of an opened, closed, and choked position; and a controller coupled to the port seal member for performing at least one of an opening, closing, and choking operation on the port seal member; wherein the port seal member integrates with the main bore of the y-block;

Clause 16, the multilateral junction system of clause 15, further comprising at least one gasket between the y-block and the port seal member, the at least one gasket configured to hydraulically isolate the lateral bore when the port seal member is in a closed position;

Clause 17, the multilateral junction system of clause 15, wherein the port seal member is controllable using at least one of a mechanical, hydraulic, electromechanical, and electromagnetic means;

Clause 18, the multilateral junction system of clause 15, wherein the controller performs an opening, closing, and choking operation on at least one port seal member using a device identifier and a control command;

Clause 19, the multilateral junction system of clause 15, wherein the lateral port is one of a D-shape and circular shape and configured to couple to a lateral leg;

Clause 20, the multilateral junction system of clause 15, wherein the y-block is a single, machined object with the main bore and the lateral bore formed therein.

What is claimed is:

1. A multilateral junction apparatus comprising:

a y-block positioned at a multilateral junction location of a well, and having formed therein a main bore and a lateral port, the lateral port having a D-shaped lateral bore in fluid communication with the main bore; wherein the y-block is a single, machined object with the main bore and the lateral bore formed therein and having a consistent internal diameter of the main bore realized over the length of the multilateral junction;

a port seal member installed within the y-block and having at least one of an opened, closed, and choked position;

at least two gaskets installed within the main bore on either side of the lateral port and positioned between the y-block and the port seal member; and wherein the port seal member integrates with the main bore of the y-block.

2. The multilateral junction apparatus of claim 1, wherein the at least two gaskets are configured to hydraulically isolate the lateral bore when the port seal member is in the closed position.

3. The multilateral junction apparatus of claim 1, further comprising a controller coupled to the port seal member for performing at least one of an opening, closing, and choking operation on the port seal member.

4. The multilateral junction apparatus of claim 3, wherein the port seal member is controllable using at least one of a mechanical, hydraulic, electromechanical, and electromagnetic means.

5. The multilateral junction apparatus of claim 4, wherein the controller performs an opening, closing, and choking operation on at least one port seal member using a device identifier and a control command.

6. The multilateral junction apparatus of claim 1, wherein the lateral port is one of a D-shape and circular shape and configured to couple to a lateral leg.

7. The multilateral junction apparatus of claim 1, wherein the multilateral junction apparatus is sized such that it can be installed in 7 feet and ⅝" casing and also allow for 3 feet and ½" inner diameter access to the main bore after the multilateral junction apparatus is installed.

8. A method of using a multilateral junction apparatus in a wellbore environment, the method comprising:

machining a y-block positioned at a multilateral junction location of a well to form a main bore and a lateral port, the lateral port having a D-shaped lateral bore in fluid communication with the main bore; wherein the y-block is a single, machined object with the main bore and the lateral bore formed therein and having a consistent internal diameter of the main bore realized over the length of the multilateral junction;

integrating a port seal member within the y-block, wherein the port seal member includes at least one of an opened, closed, and choked position;

positioning at least two gaskets within the main bore on either side of the lateral port and between the y-block and the port seal member;

coupling a first main bore tubular with an upper end of the y-block;

coupling a second main bore tubular with a lower end of the y-block;

coupling a lateral leg with the lateral port;

performing downhole wellbore operations; and controlling operation of the port seal member during the downhole wellbore operations.

9. The method of claim 8, wherein the at least two gaskets are configured to hydraulically isolate the lateral bore when the port seal member is in the closed position.

10. The method of claim 8 further comprising, performing at least one of an opening, closing, and choking operation on the port seal member.

11. The method of claim 10 further comprising, controlling the port seal member using at least one of a mechanical, hydraulic, electromechanical, and electromagnetic means.

12. The method of claim 11 further comprising, performing an opening, closing, and choking operation on at least one port seal member using a device identifier and a control command.

13. The method of claim 8 further comprises, wherein the lateral port is one of a D-shape and circular shape and configured to couple to the lateral leg.

14. The method of claim 8, wherein the multilateral junction apparatus is sized such that it can be installed in 7 feet and ⅝" casing and also allow for 3 feet and ½" inner diameter access to the main bore after the multilateral junction apparatus is installed.

15. A multilateral junction system for use in a wellbore environment, the system comprising:

a y-block positioned at a multilateral junction location of a well and having formed therein a main bore and a D-shaped lateral port, the lateral port having a D-shaped lateral bore in fluid communication with the main bore; wherein the y-block is a single, machined object with the main bore and the lateral bore formed therein and having a consistent internal diameter of the main bore realized over the length of the multilateral junction;

a port seal member installed within the y-block and having at least one of an opened, closed, and choked position;

at least two gaskets installed within the main bore on either side of the lateral port and positioned between the y-block and the port seal member; and a controller coupled to the port seal member for performing at least one of an opening, closing, and choking operation on the port seal member;

wherein the port seal member integrates with the main bore of the y-block.

16. The multilateral junction system of claim 15, wherein the at least two gaskets are configured to hydraulically isolate the lateral bore when the port seal member is in a closed position.

17. The multilateral junction system of claim 15, wherein the port seal member is controllable using at least one of a mechanical, hydraulic, electromechanical, and electromagnetic means.

18. The multilateral junction system of claim 15, wherein the controller performs the opening, closing, and choking operation on at least one port seal member using a device identifier and a control command.

19. The multilateral junction system of claim 15, wherein the lateral port is one of a D-shape and circular shape and configured to couple to a lateral leg.

20. The multilateral junction system of claim 15, wherein the multilateral junction apparatus is sized such that it can be installed in 7 feet and ⅝" casing and also allow for 3 feet and ½" inner diameter access to the main bore after the multilateral junction apparatus is installed.

* * * * *